US005102472A

United States Patent [19]

Hook

[11] Patent Number: 5,102,472

[45] Date of Patent: Apr. 7, 1992

[54] COLD REDUCED NON-AGING DEEP DRAWING STEEL AND METHOD FOR PRODUCING

[75] Inventor: Rollin E. Hook, Dayton, Ohio

[73] Assignee: Armco Steel Company, L.P., Middletown, Ohio

[21] Appl. No.: 690,142

[22] Filed: Apr. 23, 1991

Related U.S. Application Data

[63] Continuation of Ser. No. 415,817, Oct. 2, 1989, abandoned.

[51] Int. Cl.[5] ..... C21D 9/48; C22C 38/06

[52] U.S. Cl. ..... 148/2; 148/12 C; 148/12 F; 148/320

[58] Field of Search ..... 148/12 C, 12 F, 320, 148/2

[56] References Cited

FOREIGN PATENT DOCUMENTS

| | | | |
|---|---|---|---|
| 59-74237 | 4/1984 | Japan | 148/12 C |
| 60-114524 | 6/1985 | Japan | 148/12 C |
| 61-23721 | 2/1986 | Japan | 148/12 C |
| 63-29529 | 9/1988 | Japan | 148/12 C |

*Primary Examiner*—Deobrah Yee

*Attorney, Agent, or Firm*—R. J. Bunyard; L. A. Fillnow; R. H. Johnson

[57] ABSTRACT

A non-aging, cold reduced, recrystallization annealed, low manganese, aluminum killed steel having an $r_m$ value greater than 1.8 produced from a slab having a reduced hot rolling temperature. A slab consisting essentially of ≦0.08% carbon, ≦0.1% acid sol. aluminum, <0.20% manganese, all percentages by weight, the balance iron and unavoidable impurities, is hot rolled from a temperature less than about 1260° C. Preferably, the steel has an $r_m$ value of greater than 2.0 after batch annealing and is produced from a slab reheated to a temperature less than about 1175° C.

15 Claims, 3 Drawing Sheets

COLD REDUCED NON-AGING DEEP DRAWING STEEL AND METHOD FOR PRODUCING

This is a continuation of copending application Ser. No. 07/415,817 filed on Oct. 2, 1989, now abandoned.

BACKGROUND OF THE INVENTION

This invention relates to a cold reduced deep drawing aluminum killed steel. More particularly, the invention relates to a non-aging low manganese aluminum killed steel having a very high average plastic strain ratio produced from a slab having a reduced hot rolling temperature.

It is well known deep drawing steels are characterized as requiring a very high average plastic strain ratio($r_m$) of 1.8 or more. Average plastic strain ratio is defined as $r_m=(r_{0°}+r_{90°}+2r_{45°})/4$. High $r_m$ values have been achieved by adding various carbide and/or nitride formers, e.g. Ti, Cb, Zr, B, and the like, to steel melt compositions. However, addition of these elements to a melt to produce non-aging deep drawing steel is undesirable because of the added alloy costs. It is also known aluminum killed steel having an equiaxed grain structure and similar high $r_m$ values can be produced by continuous annealing if aluminum nitride is precipitated prior to cold reduction. Batch annealed aluminum killed steel having an elongated grain structure develops $r_m$ values to about 1.8 by precipitating aluminum nitride during the slow heatup prior to the onset of recrystallization during annealing. Unlike batch annealing, aluminum nitride will not precipitate prior to recrystallization during continuous annealing to form high $r_m$ values because the heating rate is too rapid. Precipitation of aluminum nitride prior to cold reduction to produce high $r_m$ values for continuously annealed aluminum killed steel is accomplished by using a high coiling temperature after hot rolling or by reheating a relatively cold slab to a temperature insufficient to re-dissolve aluminum nitride precipitated during cooling of the slab following casting.

The following prior art discloses cold reduced aluminum killed steel produced by continuous annealing. U.S. Pat. No. 4,145,235 discloses a process for producing a low manganese aluminum killed steel having high $r_m$ values by hot coiling a hot rolled sheet after hot rolling at a temperature no less than 735° C. Values for $r_m$ up to 2.09 after continuous annealing are disclosed. U.S. Pat. No. 4,478,649 discloses a process for direct hot rolling a continuously cast aluminum killed steel slab without reheating the slab. The as-cast slab is hot rolled prior to the slab cooling to a temperature below $Ar_3$ thereby avoiding precipitation of aluminum nitride. Aluminum nitride is precipitated prior to continuous annealing by hot coiling the hot rolled sheet after hot rolling at a temperature of at least 780° C. U.S. Pat. No. 4,698,102 discloses using aluminum killed steel slab reheat temperatures less than 1240° C. so that aluminum nitride precipitated during cooling of the slab following casting is not re-dissolved prior to hot rolling. Coiling temperatures after hot rolling of 620°-710° C. are disclosed to precipitate any remaining solute nitrogen prior to continuous annealing. U.S. Pat. No. 4,116,729 discloses cooling a continuously cast aluminum killed steel slab to within the temperature range of 650° C. to $Ar_3$ for at least 20 minutes to precipitate aluminum nitride. The slab is then reheated to 950°-1150° C. for hot rolling without re-dissolving the aluminum nitride. Values for $r_m$ up to 1.6 after continuous annealing are disclosed. U.S. Pat. No. 4,627,881 discloses a process for producing high $r_m$ values in continuously annealed aluminum killed steel by controlling the nitrogen to no greater than 0.0025% and the phosphorus to no greater than 0.010% with the sum of phosphorus plus five times the nitrogen no greater than 0.020%. Slabs were reheated and hot rolled within the temperature range of 1050°-1200° C. The hot rolled sheet was coiled at a temperature of less than 650° C. Cold reduced continuously annealed sheet had $r_m$ values up to 2.1. It is also known continuously annealed aluminum killed steel having high $r_m$ values can be produced by increasing the soluble aluminum in the melt. U.S. Pat. No. 3,798,076 discloses an aluminum killed steel having 0.13 to 0.33% soluble aluminum and $r_m$ values up to 1.91 after continuous annealing.

It is also known aluminum killed steel having similar high $r_m$ values can be produced by batch annealing. U.S. Pat. No. 3,959,029 discloses using conventional slab hot rolling practice so as not to precipitate aluminum nitride, i.e. keep nitrogen in solution, prior to batch annealing. Values for $r_m$ up to 2.23 were disclosed for a non-aging aluminum killed steel by decarburizing a cold reduced sheet during annealing to less than 0.01% carbon. U.S. Pat. No. 4,473,411 discloses a batch annealed aluminum killed steel having $r_m$ values up to 1.85. The sheet was produced from a slab using conventional (1260° C. slab drop-out temperature) hot rolling practice having 0.12-0.24% manganese that was hot rolled without precipitating aluminum nitride. The hot rolled sheet was cold reduced and its cold spot temperature carefully controlled during annealing to develop high $r_m$ values.

As previously indicated, addition of carbide and/or nitride forming elements to a melt to produce non-aging deep drawing steel is undesirable because of the alloy costs. Using elevated coiling temperatures to produce non-aging deep drawing aluminum killed steel is also undesirable because of uneven cooling rates and the scale formed on the hot rolled sheet during cooling from the elevated coiling temperature is more difficult to remove. The melt processing techniques, i.e. vacuum degassing, ladle stirring, fluxing, and the like, required to reduce the residual carbon, nitrogen or phosphorus also are expensive. Accordingly, there remains a need for an inexpensive non-aging deep drawing aluminum killed steel. More particularly, there remains a need for a non-aging aluminum killed steel having an $r_m$ value of 1.8 or more that can be produced using conventional processing or using a technique that does not add, and preferably saves, cost over that of conventional processing.

BRIEF SUMMARY OF THE INVENTION

This invention relates to a non-aging aluminum killed steel and a method of producing including a cold reduced and recrystallization annealed sheet having an $r_m$ value of at least 1.8, the sheet consisting essentially of $\leqq$0.08% carbon, $\leqq$0.1% acid sol. aluminum, <0.20% manganese, all percentages by weight, the balance iron and unavoidable impurities, the sheet produced from a slab having a temperature less than about 1260° C. prior to hot rolling wherein the slab having nitrogen in solution is hot rolled to a sheet.

A principal object of the invention includes producing a non-aging, deep drawing, aluminum killed steel without using melt alloying additions and using conventional recrystallization annealing practice. A further object of the invention includes producing a non-aging, deep drawing, batch annealed, aluminum killed steel without using: melt alloying additions; melt degassing, stirring or fluxing to reduce residual carbon, nitrogen, or phosphorus to very low amounts; or elevated coiling temperature after hot rolling.

A feature of the invention includes a non-aging, cold reduced, recrystallization annealed, aluminum killed steel sheet having an $r_m$ value of at least 1.8 including ≦0.08% carbon, ≦0.1% acid sol. aluminum, <0.20% manganese, the balance iron and unavoidable impurities, all percentages by weight, the sheet produced from a slab having a temperature less than about 1260° C. prior to hot rolling wherein the slab having nitrogen in solution is hot rolled to a sheet.

Another feature of the invention includes a non-aging, cold reduced, recrystallization annealed, aluminum killed steel sheet having an $r_m$ value of at least 2.0 including ≦0.05% carbon, 0.02–0.1% acid sol. aluminum, ≦0.20% manganese, the balance iron and unavoidable impurities, all percentages by weight, the sheet produced from a continuously cast slab having a temperature less than about 1175° C. prior to hot rolling wherein the slab having nitrogen in solution is hot rolled to a sheet.

Another feature of the invention includes a non-aging, cold reduced, recrystallization batch annealed, aluminum killed steel sheet having an $r_m$ value of at least 1.8 including ≦0.08% carbon, ≦0.1% acid sol. aluminum, <0.20% manganese, the balance iron and unavoidable impurities, all percentages by weight, the sheet produced from a slab having a hot rolling temperature less than about 1260° C. wherein the slab is hot rolled to a sheet having nitrogen in solution.

Another feature of the invention includes a non-aging, cold reduced, recrystallization batch annealed, aluminum killed steel sheet having an $r_m$ value of at least 2.0 including ≦0.05% carbon, 0.02–0.1% acid sol. aluminum, <0.20% manganese, the balance iron and unavoidable impurities, all percentages by weight, the sheet produced from a continuously cast slab cooled to a temperature less than about $Ar_3$ prior to hot rolling, the slab being reheated to a temperature less than about 1175° C. prior to hot rolling wherein the slab is hot rolled to a sheet having nitrogen in solution.

Another feature of the invention is a method of producing a non-aging, aluminum killed steel sheet having an $r_m$ value of at least 1.8 including: providing a slab consisting essentially of ≦0.08% carbon, ≦0.1% acid sol. aluminum, <0.20% manganese, all percentages by weight, the balance iron and unavoidable impurities, hot rolling the slab from a temperature less than about 1260° C. to produce a sheet with the slab having nitrogen in solution, descaling the hot rolled sheet, cold reducing the descaled sheet, recrystallization annealing the cold reduced sheet wherein the annealed sheet is non-aging and has an $r_m$ value of at least 1.8.

Another feature of the invention is a method of producing a non-aging, aluminum killed steel sheet having an $r_m$ value of at least 2.0 including: providing a melt consisting essentially of ≦0.05% carbon, 0.02–0.1% acid sol. aluminum, <0.20% manganese, all percentages by weight, the balance iron and unavoidable impurities, casting the melt into a slab, hot rolling the slab from a temperature less than about 1175° C. to produce a sheet with the slab having nitrogen in solution, descaling the hot rolled sheet, cold reducing the descaled sheet, recrystallization annealing the cold reduced sheet wherein the annealed sheet is non-aging and has an $r_m$ value of at least 2.0.

Another feature of the invention is a method of producing a non-aging, aluminum killed steel sheet having an $r_m$ value of at least 1.8 including: providing a slab consisting essentially of ≦0.08% carbon, ≦0.1% acid sol. aluminum, <0.20% manganese, all percentages by weight, the balance iron and unavoidable impurities, hot rolling the slab from a temperature less than about 1260° C. to produce a sheet with the slab having nitrogen in solution, descaling the hot rolled sheet, cold reducing the descaled sheet, recrystallization batch annealing the cold reduced sheet wherein the annealed sheet is non-aging and has an $r_m$ value of at least 1.8.

Another feature of the invention is a method of producing a producing a non-aging, aluminum killed steel sheet having an $r_m$ value of at least 2.0 including: providing a melt consisting essentially of ≦0.05% carbon, 0.02–0.1% acid sol. aluminum, <0.20% manganese, all percentages by weight, the balance iron and unavoidable impurities, casting the melt into a slab, cooling the slab to a temperature below $Ar_3$, reheating the slab to a temperature less than about 1175° C., hot rolling the slab to a sheet having a finishing temperature ≧$Ar_3$ and a coiling temperature ≦593° C. wherein the sheet has nitrogen in solution, descaling the hot rolled sheet, cold reducing the descaled sheet, recrystallization batch annealing the cold reduced sheet wherein the annealed sheet is non-aging and has an $r_m$ value of at least 2.0.

An advantage of the invention is that a non-aging aluminum killed steel having a high average plastic strain ratio of 1.8 or more can be produced by using a substantially reduced slab reheat temperature thereby effecting savings in energy costs, improving yields and productivity, and extending slab reheat furnace life. A further advantage of the invention is that a non-aging aluminum killed steel having a high average plastic strain ratio of 1.8 or more can be produced from thin continuously cast slabs.

The above and other objects, features, and advantages of the invention will become apparent upon consideration of the detailed description.

DETAILED DESCRIPTION OF THE PREFERRED EMBODIMENT

Figure 1:
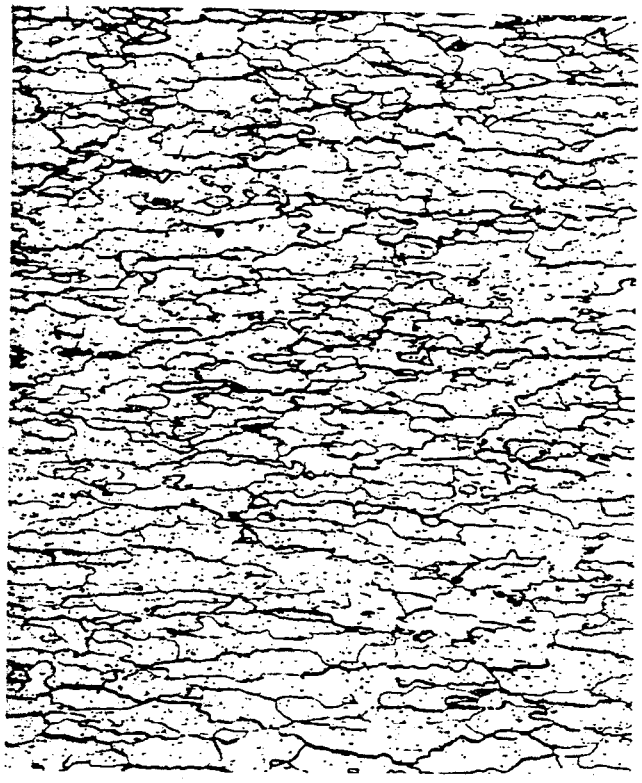
FIG. 1 is a photomicrograph at 100× magnification of the grain structure of a cold reduced recrystallization batch annealed sheet for one embodiment of the invention.

It will be understood by sheet is meant to include both cold reduced strip of indefinite length and cold reduced strip cut into definite lengths. It also will be understood the cold reduced sheets of the invention can be produced from slabs continuously cast from a melt or from ingots rolled on a slabbing mill.

The chemical composition of the steel in accordance with the present invention includes <0.20% manganese, ≦0.1% acid sol. aluminum, ≦0.08% carbon, all percentages by weight, the balance iron and unavoidable impurities. Manganese preferably is at least 0.05 weight % to prevent hot shortness due to sulfur during hot rolling. At least 0.01 acid sol. weight % aluminum is required to deoxidize the melt and to fix nitrogen as aluminum nitride to make the recrystallization annealed steel non-aging. At least about 0.02 acid sol. weight % aluminum is preferred. Aluminum should not exceed 0.1 acid sol. weight % because the steel would be too hard and more costly. Similarly, carbon should not exceed 0.08 weight % because the recrystallization annealed steel would be too hard. Preferably, carbon is in the range of 0.03–0.05 weight %. Conventional residual amounts of <0.01 weight % nitrogen, <0.02 weight % phosphorus and <0.018% sulfur are acceptable.

Slabs of conventional thickness of about 150–300 mm are hot rolled by gradually being reduced in thickness to about 30 mm in a series of roughing stands and further reduced in thickness to about 2.5 mm by a series of finishing stands. The hot rolled sheet is then coiled, descaled, cold reduced, and recrystallization annealed. Non-aging aluminum killed steel produced by batch annealing requires that a considerable amount of nitrogen present in the steel be in solid solution (not precipitated as aluminum nitride) in the hot rolled sheet after hot rolling. For slabs having cooled prior to hot rolling to a temperature below $Ar_3$, they would have to be reheated to re-dissolve sufficient aluminum nitride needed in the hot rolled sheet for the formation of the recrystallization texture necessary for good $r_m$ values. For slabs directly hot rolled after continuous casting or from a slabbing mill, nitrogen has not precipitated as aluminum nitride if they have not cooled to a temperature below $Ar_3$. Accordingly, it may not be necessary to reheat the slabs to as high a temperature as for slabs previously cooled to below $Ar_3$ to re-dissolve the aluminum nitride.

Aluminum nitride precipitation during the heating stage of the batch annealing cycle results in the formation of the desired strong {111} recrystallization texture parallel to the normal direction which provides $r_m$ values required for good drawing performance. For steel that is cold reduced and recrystallization batch annealed, the thermal-mechanical processing of slabs during hot rolling is conducted in a manner so as to minimize the amount of aluminum nitride in the hot rolled sheet. In a paper entitled SOLUTION AND PRECIPITATION OF ALUMINUM NITRIDE IN RELATION TO THE STRUCTURE OF LOW CARBON STEELS, Trans. ASM, 46 (1954), p. 1470–1499, by W. C. Leslie et al, incorporated herein by reference, it is disclosed the solution temperature of aluminum nitride during hot rolling is a function of the product of the weight percentages of acid soluble aluminum and total nitrogen present in the steel. Whether continuously cast or produced from ingots, slabs of conventional thickness that have cooled to below the $Ar_3$ are heated prior to hot rolling to a temperature of about 1260° C. or more for re-solution of much of the aluminum nitride formed during cooling of the slab after casting. Following reheating, thick slabs are hot rolled through the roughing stands where the temperature of the slabs falls from about 1260° C. to about 1040° C. over a period of about 3.25 to 3.75 minutes. The steel at about 1040° C. and having a thickness of about 25–30 mm is further reduced to a thickness of about 2.5 mm by passing through a multi-stand finishing mill. The steel temperature falls from about 1040° C. to a sheet exit temperature (finishing temperature) as low as about 870° C. over a period of about 10 sec. The isothermal precipitation of aluminum nitride starts at temperatures above about 700° C., reaching a maximum at about 815° C. Temperatures above 700° C. are therefore to be avoided during hot rolling if aluminum nitride precipitation is to be minimized. Slabs preferably are processed to have a finishing temperature of at least 870° C. to not only avoid aluminum nitride precipitation but also control grain size. Coiling temperature also is controlled to minimize aluminum nitride precipitation. On exiting the finishing mill, the sheet is water quenched to a temperature less than 650° C., more preferably to less than 593° C., and preferably to about 566° C. before being wrapped into a coil. This is a suitable temperature from which to initiate the long time process of cooling the hot rolled sheet in coiled form and still avoid the precipitation of an undue amount of aluminum nitride. Thus, much of the nitrogen is retained in solution in the hot rolled sheet prior to cold reduction. Elevated coiling temperatures above about 700° C. result in excessive aluminum nitride precipitation virtually guaranteeing failure to obtain high $r_m$ values and good deep drawing properties following cold reduction and batch annealing.

I have determined slabs do not have to be rolled from a reheat temperature of about 1260° C. or more to obtain high $r_m$ values after batch annealing. By controlling manganese to less than about 0.20% by weight, slabs can be hot rolled from a temperature less than about 1260° C. More preferably, the slabs are hot rolled from a temperature less than about 1175° C. and preferably as low as about 1149° C.

By way of example, aluminum killed cast slab ingots were prepared in the laboratory by vacuum melting. Compositions by weight percent for the ingots are shown in Table 1.

TABLE 1

| STEEL | C | N | AL (acid sol.) | S | MN |
|---|---|---|---|---|---|
| A | 0.046 | 0.007 | 0.069 | 0.008 | 0.07 |
| B | 0.044 | 0.007 | 0.071 | 0.007 | 0.10 |
| C | 0.036 | 0.008 | 0.073 | 0.008 | 0.13 |
| D | 0.046 | 0.007 | 0.071 | 0.008 | 0.16 |
| E | 0.042 | 0.007 | 0.077 | 0.009 | 0.22 |

Steels A–E were cast into slab ingots 28.6 mm thick, 102 mm wide, and 178 mm long and cooled to ambient. Four slabs for each steel composition were reheated from ambient temperature to 1093° C., 1149° C., 1204° C., and 1260° C. for hot rolling. The residence time of the slabs in the reheat furnace was one hour. The slabs were hot rolled to sheets having a thickness of 3.6 mm and a finishing temperature of 927° C. The sheets were water cooled to 566° C. to simulate a coiling temperature and slowly furnace cooled to ambient. The sheets then were descaled by pickling and cold reduced 70% to a thickness of 1.07 mm. The cold reduced sheets then were heated at a rate of 28° C./hr (simulating batch annealing) to a temperature of 649° C., were soaked at this temperature for 4 hours and then cooled at a rate of 28° C./hr. The annealed sheets then were temper rolled 1%. The $r_m$ values as a function of manganese and slab reheat temperature are shown in Table 2.

TABLE 2

| STEEL | 1093° C. | 1149° C. | 1204° C. | 1260° C. |
|---|---|---|---|---|
| A | 1.32 | 2.48 | 2.26 | 1.78 |
| B | 1.26 | 2.38 | 1.91 | 2.45 |
| C | 1.21 | 2.39 | 1.89 | 1.94 |
| D | 1.19 | 2.30 | 1.93 | 1.89 |
| E | 1.09 | 1.44 | 1.71 | 1.79 |

The results of Table 2 show that all manganese composition steels had $r_m$ values of at least about 1.8 or more when using a conventional hot rolling temperature of 1260° C. Inventive steels A–D having manganese compositions less than 0.20% had very high $r_m$ values when hot rolled at the reduced temperatures of 1149° C. and 1204° C. In fact, using a hot rolling temperature of only 1149° C. resulted in exceptionally high $r_m$ values of 2.30 or more for inventive steels A–D. However, further reducing the slab temperature to 1093° C. resulted in very low $r_m$ values of 1.32 or less for all manganese compositions indicative apparently of insufficient nitrogen being in solution in the hot rolled sheet prior to cold reduction. Steel E having high manganese had $r_m$ values less than 1.8 when hot rolled from slabs having reduced temperatures of 1149° C. and 1204° C. Apparently, reducing the manganese content to less than 0.20 weight % has a dramatic effect on the amount of nitrogen in solution in a hot rolled sheet rolled from a slab having a reduced temperature. By controlling the manganese to less than 0.20 weight %, apparently sufficient nitrogen is present in the hot rolled sheet for the formation of the recrystallization texture necessary for good $r_m$ values after batch annealing.

Figure 2:
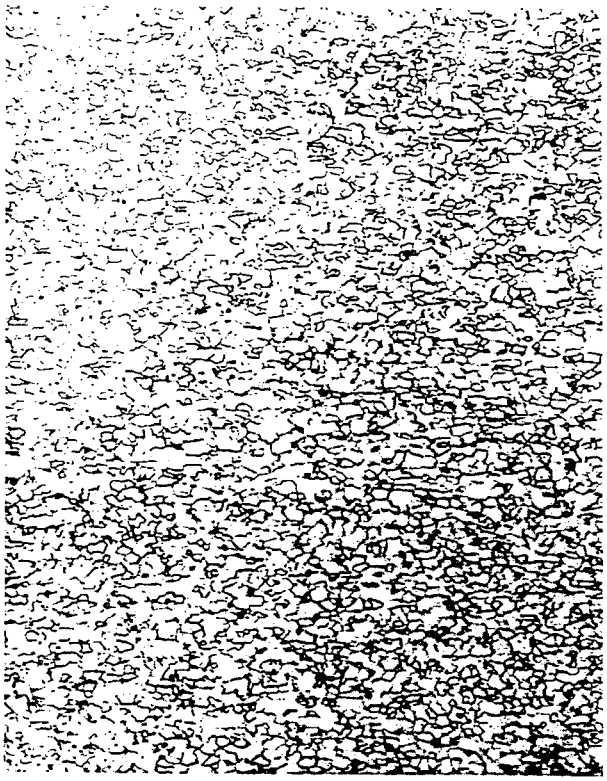
FIG. 2 is a photomicrograph at 100× magnification of the grain structure of a cold reduced recrystallization batch annealed sheet for a steel having the same composition as that of FIG. 1 but produced using a process outside the invention.
Figure 3:
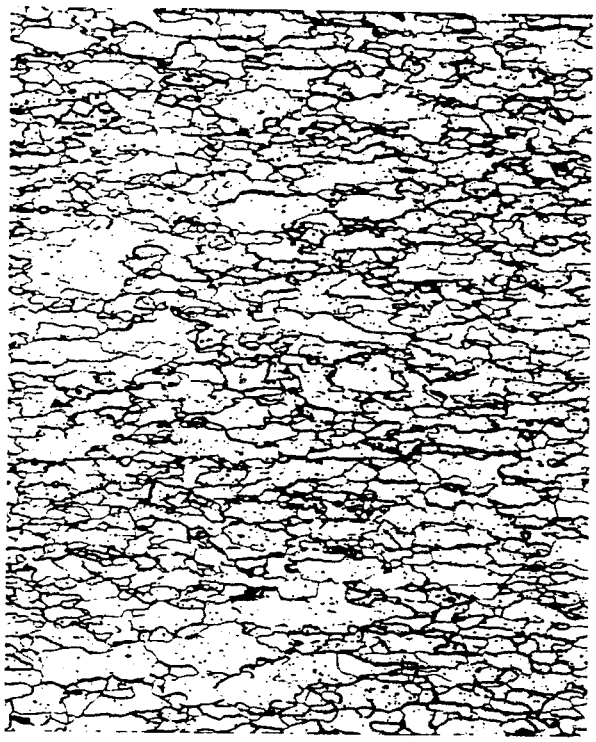
FIG. 3 is a photomicrograph at 100× magnification of the grain structure of a cold reduced recrystallization batch annealed sheet using the process of the invention but having a composition outside the invention.
Figure 4:
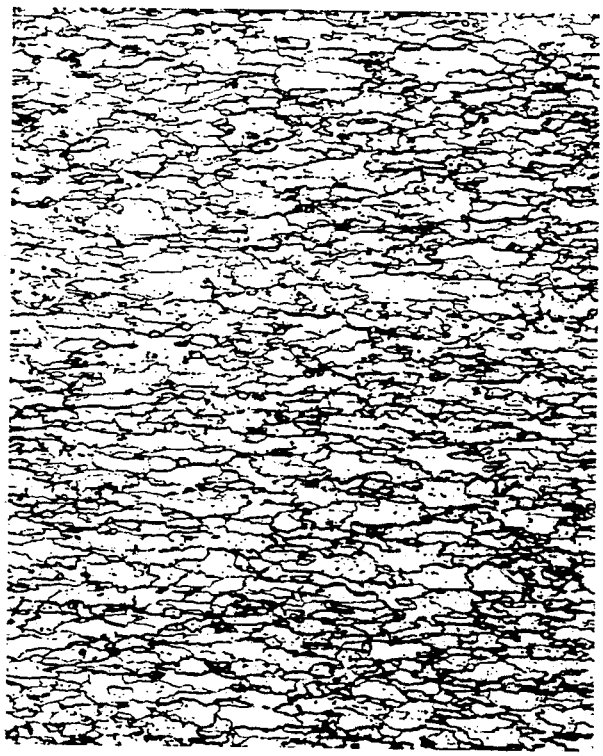
FIG. 4 is a photomicrograph at 100× magnification of the grain structure of a cold reduced recrystallization batch annealed sheet for a steel having conventional composition and processing.

It is well known non-aging, cold reduced, batch annealed, aluminum killed steel is characterized by a grain structure having an elongation of about 2.0 or more. Such a grain elongation is indicative that aluminum nitride precipitated during the slow heatup prior to the onset of recrystallization during annealing. It is also known the solution temperature of aluminum nitride is a function of the product of the weight percentages of nitrogen and aluminum in the steel. According to Leslie et al, the nitrogen and aluminum compositions of inventive steels A–D would have suggested aluminum nitride reheat solution temperatures prior to hot rolling of 1260° C. or more. However, the grain structures of inventive steels A–D after cold reduction and batch annealing had very high elongations well in excess of conventional elongations, i.e. ≧2.0, for reduced slab reheat temperatures of 1149° C. and 1204° C. For example, FIG. 1 shows a highly elongated grain structure for steel B having the $r_m$ value of 2.38 for the sheet that was cold reduced and batch annealed at 649° C. for four hours. The sheet was produced from the slab reheated to 1149° C. and having a simulated coiling temperature of 566° C. after hot rolling. FIG. 2 shows an equiaxed grain structure for steel B having the $r_m$ value of 1.26 and having the same processing as steel B in FIG. 1 except the slab was reheated to only 1093° C. FIG. 2 demonstrates a slab temperature of 1093° C. apparently does not result in sufficient solute nitrogen in the hot rolled sheet to produce an elongated grain structure after cold reduction and batch annealing. FIG. 3 shows a conventional partially elongated grain structure for steel E having high manganese and the $r_m$ value of 1.44. Steel E in FIG. 3 had the same processing as steel B in FIG. 1. The only significant difference for steel E in FIG. 3 from that of steel B in FIG. 1 is that the steel in FIG. 3 had 0.22 weight % manganese versus 0.10 weight % for the steel in FIG. 1. It should be noted that not only is the elongation of the grain structure of the steel in FIG. 3 significantly less than that of the steel in FIG. 1 but also the grain structure of FIG. 3 includes a significant number of equiaxed grains. FIG. 4 shows a conventional elongated grain structure for steel E having the $r_m$ value of 1.79. Steel E in FIG. 4 was processed identically to steel B in FIG. 1 except the slab was reheated to 1260° C. The grain structure of the steel in FIG. 4 having high manganese content and a conventional hot rolling slab temperature had a grain elongation approaching that of the steel in FIG. 1. Unlike the grain structure for steel E in FIG. 3 using a reduced hot rolling temperature, the grain structure for steel E in FIG. 4 using the conventional slab hot rolling temperature had very few equiaxed grains. The remaining inventive steels A,C and D having reduced slab reheat temperatures of 1149° C. and 1204° C. had similar grain elongations to that shown in FIG. 1. Steels A,C and D having a reduced slab reheat temperature of 1093° C. had grain structures similar to that shown in FIG. 2. Steels A,C and D having a conventional slab reheat temperature of 1260° C. had grain elongations similar to that shown in FIG. 4. The prior art teaches steels A–D should not have had sufficient solute nitrogen in sheets hot rolled from slabs at the reduced temperatures of 1149° C. and 1204° C., particularly 1149° C., to produce an elongated grain structure and high $r_m$ values after cold reduction and batch annealing. Contrary to these teachings, I determined that cold reduced and batch annealed steels A–D having manganese less than 0.20 weight % and produced from sheets hot rolled from slabs reheated to temperatures of only 1149° C. and 1204° C. had grain elongations well in excess of conventional elongations. The reason for obtaining these elongated grain structures at reduced slab hot rolling temperatures is not known. Although not demonstrated analytically, a possible explanation for this unexpected result for inventive steels A–D is that they apparently did have sufficient nitrogen in solution in the hot rolled sheet to form the classic elongated grain (and exceptionally high $r_m$ values) after cold reduction and simulated batch annealing.

Those skilled in the art will appreciate that slabs having conventional thicknesses of 150–300 mm need an initial temperature of about 1204° C. (depending on the aluminum and nitrogen content) or more to be hot rolled and have a finishing temperature of at least about 870° C. The most preferred slab temperature of the invention of no more than about 1149° C. has practical application for thin continuously cast slabs having thicknesses about 25–50 mm. Further cost savings are possible by casting a melt into thin slabs rather than thick slabs having a conventional thickness of 150 mm or more. By casting into a thin slab, time and energy for hot rolling to a sheet would be minimized. For example, a thin slab would require no or only minimal reduction using roughing stands. In addition to saving time and energy during rolling, further energy could be saved because the initial slab temperature could be considerably less than that required for thick slabs. Instead of 1260° C., thin slabs can be heated to greater than than 1093° C. and still be satisfactorily hot rolled into a non-aging low manganese batch annealed aluminum killed steel having very a high $r_m$ value.

The hot rolling practice disclosed herein for the inventive low manganese aluminum killed batch annealed steel may develop high $r_m$ values for continuously annealed steel as well. If so, it would be possible to in-line continuously anneal the cold reduced sheet on a hot dip metallic coating line. It was indicated above that non-aging, deep drawing, aluminum killed steel having high $r_m$ values can be produced by continuous annealing when aluminum nitride is precipitated prior to cold reduction. For example, the inventive low manganese steel could be hot rolled using the reduced hot rolling temperature and an elevated coiling temperature to insure aluminum nitride precipitation during cooling after hot rolling. For a steel having a carbon range of 0.03–0.08 weight %, a very high coiling temperature of at least about 700° C. is required to coarsen the carbides. Alternatively, a melt for producing the inventive low manganese steel could be produced having the carbon reduced to ≦0.02 weight % and a lower elevated coiling temperature of at least about 650° C. is satisfactory. Even though much of the nitrogen would be in solution in the slab immediately prior to and during hot rolling for direct rolled slabs or slabs having cooled to below $Ar_3$ and reheated to temperatures of at least 1149° C., most of it would have precipitated as aluminum nitride in the hot rolled sheet following coiling as a result of using the elevated coiling temperature. For slabs having cooled to below $Ar_3$ and reheated to temperatures as low as 1093° C. or less, an elevated coiling temperature would not be necessary because sufficient aluminum nitride already would be precipitated in the slab prior to hot rolling. Although the above theory has not been demonstrated, the following experiment strongly suggests this probably would occur. Steels A–E were processed identically to that for the example above for Table 2 except they were given an elevated simulated coiling temperature of 704° C. instead of 566° C. The $r_m$ values as a function of manganese and slab reheat temperature are shown in Table 3.

TABLE 3

| STEEL | 1093° C. | 1149° C. | 1204° C. | 1260° C. |
|---|---|---|---|---|
| A | 1.30 | 1.28 | 1.41 | 1.35 |
| B | 1.21 | 1.26 | 1.30 | 1.29 |
| C | 1.21 | 1.28 | 1.25 | 1.27 |
| D | 1.13 | 1.21 | 1.21 | 1.21 |
| E | 1.11 | 1.15 | 1.13 | 1.15 |

It was determined for all compositions and slab temperatures the $r_m$ values were diminished to 1.41 or less for these simulated batch annealed sheets suggesting much of the nitrogen was precipitated as aluminum nitride prior to cold reduction. Conversely, such a cold reduced sheet having insufficient solute nitrogen for forming high $r_m$ values in batch annealed sheets would appear ideal for developing high $r_m$ values by continuously annealing.

Figure 5:
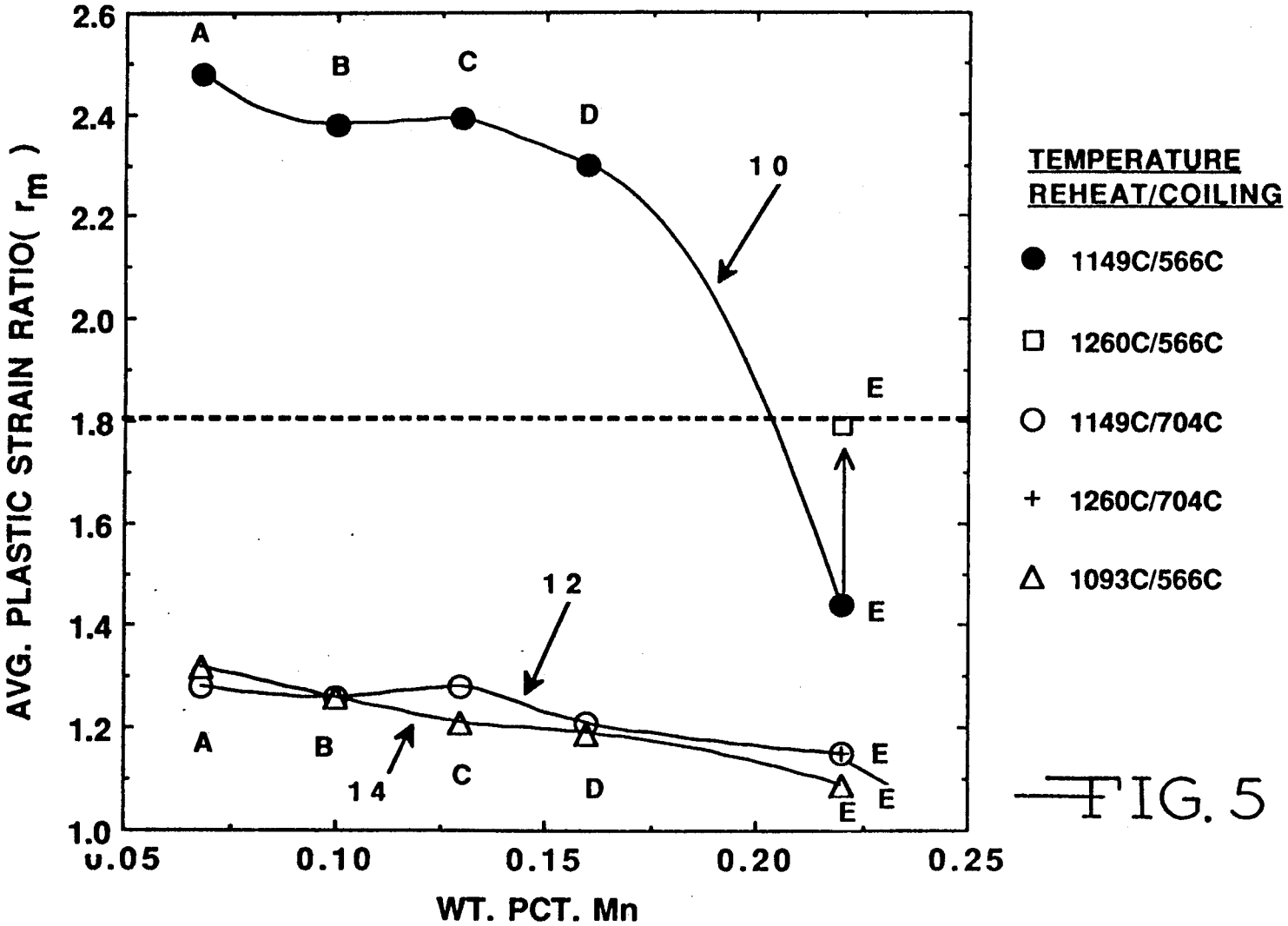
FIG. 5 is a graph of the $r_m$ values of cold reduced batch annealed sheets as a function of manganese composition, slab temperature and hot rolling coiling temperature.

The $r_m$ values in Tables 2 and 3 are graphically shown in FIG. 5. Upper curve 10 shows the low manganese inventive steels A–D having $r_m$ values well above 1.8 when cold reduced and batch annealed from sheet produced from slabs hot rolled at the reduced temperature of 1149° C. and having the coiling temperature of 566° C. The $r_m$ value for high manganese steel E having identical processing dropped to 1.44. When the slab temperature for steel E was increased to the conventional temperature of 1260° C., the $r_m$ value was increased to 1.79. When the slabs for steels A–E were reheated to 1149° C. but had the hot rolling coiling temperature increased to 704° C., the $r_m$ values dropped to 1.28 or less as shown in curve 12. When the slabs for steels A–E were reheated to 1093° C. and had a coiling temperature of 566° C., all $r_m$ values were 1.30 or less as shown in bottom curve 14.

Various modifications can be made to the invention without departing from the spirit and scope of it. For example, the low manganese steel of the invention can be produced from continuously cast thin or thick slabs as well as thick slabs produced from ingots. For sheet to be recrystallization batch annealed, various reduced slab reheat temperatures can be used so long as the hot rolling finishing temperature is above $Ar_3$ and the coiling temperature preferably is below 593° C. Therefore, the limits of the invention should be determined from the appended claims.

I claim:

1. An aluminum killed steel, comprising:

a cold reduced, recrystallization batch annealed, non-aging sheet characterized by an elongated grain structure and having an $r_m$ value of at least 1.8, said sheet consisting essentially of ≦0.08% carbon, ≦0.1% acid sol. aluminum, <0.20% manganese, all percentages by weight, the balance iron and unavoidable impurities, said sheet having been produced from a slab having a hot rolling temperature less than about 1260° C. wherein said slab is hot rolled to a sheet having nitrogen in solution.

2. An aluminum killed steel, comprising:

a cold reduced, recrystallization batch annealed, non-aging sheet characterized by an elongated grain structure and having an $r_m$ value of at least 2.0, said sheet consisting essentially of ≦0.05% carbon, 0.02–0.1% acid sol aluminum, <0.20% manganese, all percentages by weight, the balance iron and unavoidable impurities, said sheet having been produced from a continuously cast slab having a hot rolling temperature less than about 1175° C. wherein said slab is hot rolled to a sheet having nitrogen in solution.

3. The steel of claim 1 wherein said slab is continuously cast to a thickness of about 25–50 mm.

4. The steel of claim 1 wherein said slab is a continuously cast slab having cooled to a temperature less than about $Ar_3$ prior to hot rolling, said cooling causing precipitation of aluminum nitride, said slab having been reheated to less than 1260° C. prior to hot rolling to redissolve said aluminum nitride.

5. The steel of claim 1 wherein said hot rolled sheet has a hot rolling coiling temperature less than 593° C.

6. The steel of claim 1 wherein said batch annealing is at a temperature of at least 649° C.

7. An aluminum killed steel, comprising:

a cold reduced, recrystallization batch annealed, non-aging sheet characterized by an elongated grain structure and having an $r_m$ value of at least 2.0, said sheet consisting essentially of ≦0.05% carbon, 0.02–0.1% acid sol aluminum, <0.20% manganese, all percentages by weight, the balance iron and unavoidable impurities, said sheet having been produced from a continuously cast slab, said slab having cooled to a temperature less than about $Ar_3$ prior to hot rolling, said slab having been reheated to a temperature less than 1175° C. prior to said hot rolling wherein said slab is hot rolled to a sheet having nitrogen in solution, said hot rolling including a finishing temperature $\geqq Ar_3$ and a coiling temperature $\leqq 593°$ C.

8. The steel of claim 7 wherein said slab is continuously cast to a thickness less than 50 mm.

9. A method of producing an aluminum killed steel, comprising:

providing a slab consisting essentially of $\leqq 0.08\%$ carbon, $\leqq 0.1\%$ acid sol aluminum, $<0.20\%$ manganese, all percentages by weight, the balance iron and unavoidable impurities, hot rolling said slab having a hot rolling temperature less than about 1260° C. to a sheet having nitrogen in solution, coiling said hot rolled sheet, descaling said hot rolled sheet, cold reducing said descaled sheet, recrystallization batch annealing said cold reduced sheet wherein said annealed sheet is non-aging, characterized by an elongated grain structure and has an $r_m$ value of at least 1.8.

10. A method of producing an aluminum killed steel, comprising:

providing a melt consisting essentially of $\leqq 0.05\%$ carbon, 0.02–0.1% acid sol aluminum, $<0.20\%$ manganese, all percentages by weight, the balance iron and unavoidable impurities, casting said melt into a slab, hot rolling said slab having a hot rolling temperature less than about 1175° C. to a sheet having nitrogen in solution, coiling said hot rolled sheet, descaling said hot rolled sheet, cold reducing said descaled sheet, recrystallization batch annealing said cold reduced sheet wherein said annealed sheet is non-aging, characterized by an elongated grain structure and has an $r_m$ value of at least 2.0.

11. The method of claim 9 including the additional steps of continuously casting said slab and cooling said slab to a temperature below $Ar_3$ after casting.

12. The method of claim 9 including the additional step of continuously casting said slab having a thickness of 25–50 mm.

13. The method of claim 9 wherein the finishing temperature of said hot rolled sheet is $\geqq Ar_3$ and the coiling temperature of said hot rolled sheet is $\leqq 593°$ C.

14. The method of claim 9 wherein said batch annealing is at a temperature of at least 649° C.

15. A method of producing an aluminum killed steel, comprising:

providing a melt consisting essentially of $\leqq 0.05\%$ carbon, 0.02–0.1% acid sol aluminum, $<0.20\%$ manganese, all percentages by weight, the balance iron and unavoidable impurities, casting said melt into a slab, cooling said slab to a temperature below $Ar_3$, reheating said slab to a temperature less than about 1175° C., hot rolling said slab to a sheet having a finishing temperature $\geqq Ar_3$, coiling said hot rolled sheet at a temperature $\leqq 593°$ C. wherein said sheet has nitrogen in solution, descaling said hot rolled sheet, cold reducing said descaled sheet, recrystallization batch annealing said cold reduced sheet wherein said annealed sheet is non-aging, characterized by an elongated grain structure and has an $r_m$ value of at least 2.0.

* * * * *